US008523123B2

(12) United States Patent
Chiu

(10) Patent No.: US 8,523,123 B2
(45) Date of Patent: Sep. 3, 2013

(54) FOLDABLE TOOL STAND

(75) Inventor: Cheng-Hung Chiu, Taichung (TW)

(73) Assignee: Rexon Industrial Corp., Ltd., Taichung (TW)

( * ) Notice: Subject to any disclaimer, the term of this patent is extended or adjusted under 35 U.S.C. 154(b) by 695 days.

(21) Appl. No.: 12/720,883

(22) Filed: Mar. 10, 2010

(65) Prior Publication Data

US 2010/0229767 A1 Sep. 16, 2010

Related U.S. Application Data

(60) Provisional application No. 61/159,268, filed on Mar. 11, 2009.

(30) Foreign Application Priority Data

Mar. 11, 2009 (TW) ..... 98107948 A

(51) Int. Cl.
*F16M 11/38* (2006.01)

(52) U.S. Cl.
USPC ..... 248/166; 248/439; 280/638; 280/639; 108/115; 108/117

(58) Field of Classification Search
USPC ..... 248/150, 164, 166, 439, 370, 129, 248/423, 434, 436, 173, 440, 136, 432; 280/30, 280/47, 24, 35, 38, 639, 641, 645, 651, 652, 280/659, DIG. 6, 638, 654; 211/200, 201, 211/13.1; 108/115, 117, 118, 119, 120, 12, 108/102, 132, 11; 269/139, 134, 137, 16
See application file for complete search history.

(56) References Cited

U.S. PATENT DOCUMENTS

| | | | | | |
|---|---|---|---|---|---|
| 611,223 | A | * | 9/1898 | Ritchie | 108/117 |
| 1,404,537 | A | * | 1/1922 | Mendelson | 248/432 |
| 1,584,938 | A | * | 5/1926 | Higbee, Jr. | 359/862 |
| 1,844,077 | A | * | 2/1932 | Silverman | 248/432 |
| 1,881,047 | A | * | 10/1932 | Doman | 108/117 |
| 1,982,205 | A | * | 11/1934 | Doman | 108/117 |
| 2,096,994 | A | | 10/1937 | Millen | |
| 2,318,945 | A | | 5/1943 | Johannsen | |
| 2,372,003 | A | | 3/1945 | Kennedy | |
| 2,560,849 | A | * | 7/1951 | Dahlstrom | 108/117 |
| 2,579,639 | A | * | 12/1951 | Adams | 280/30 |

(Continued)

FOREIGN PATENT DOCUMENTS

| | | |
|---|---|---|
| CN | 2573185 | 9/2003 |
| DE | 26 45 773 A1 | 4/1978 |

(Continued)

*Primary Examiner* — Kimberly Wood
(74) *Attorney, Agent, or Firm* — Bacon & Thomas, PLLC

(57) ABSTRACT

A foldable tool stand includes a base frame, a platform pivotally and slidingly connected to the base frame at a first side, a leg support having a top end pivotally connected to the base frame, a pair of links pivotally coupled between a second side of the platform and the base frame, a driving member pivotally connected to the links, and a follower set pivotally connected to the base frame. The driving member and follower set interact to selectively lock the foldable tool stand in either an extended supporting position, where the second side of the platform is spaced from the base frame, or a collapsed position, where the second side of the platform lies adjacent to the base frame.

20 Claims, 8 Drawing Sheets

(56) References Cited

U.S. PATENT DOCUMENTS

| | | | | | |
|---|---|---|---|---|---|
| 2,616,719 | A | * | 11/1952 | Heideman | 280/648 |
| 2,624,469 | A | * | 1/1953 | Adamson et al. | 108/116 |
| 2,670,216 | A | * | 2/1954 | Leonard | 280/643 |
| 2,829,863 | A | * | 4/1958 | Gibson | 254/8 C |
| 2,880,047 | A | | 3/1959 | Haag | |
| 3,014,760 | A | * | 12/1961 | Gard | 297/188.08 |
| 3,110,476 | A | * | 11/1963 | Farris | 254/122 |
| 3,212,788 | A | * | 10/1965 | Adler | 280/643 |
| 3,411,799 | A | * | 11/1968 | Felsher | 280/649 |
| 3,655,212 | A | | 4/1972 | Krass et al. | |
| 3,783,799 | A | | 1/1974 | Dupuis | |
| 4,079,679 | A | | 3/1978 | Bechtold | |
| 4,202,284 | A | | 5/1980 | Parsons, Sr. | |
| 4,483,524 | A | | 11/1984 | Basten et al. | |
| 4,558,648 | A | | 12/1985 | Franklin et al. | |
| 4,561,622 | A | | 12/1985 | Heinzel | |
| 4,611,823 | A | | 9/1986 | Haas | |
| 4,728,118 | A | | 3/1988 | Haas | |
| 4,967,672 | A | | 11/1990 | Leather | |
| 4,969,496 | A | | 11/1990 | Romans | |
| 5,014,628 | A | | 5/1991 | Roberts | |
| 5,087,013 | A | | 2/1992 | Gress et al. | |
| 5,109,778 | A | | 5/1992 | Berkowitz et al. | |
| 5,323,713 | A | | 6/1994 | Luyk et al. | |
| 5,325,640 | A | | 7/1994 | Luedke et al. | |
| 5,421,272 | A | | 6/1995 | Wilmore | |
| 5,454,575 | A | | 10/1995 | Del Buono | |
| 5,499,831 | A | * | 3/1996 | Worth et al. | 280/30 |
| 5,560,582 | A | | 10/1996 | Beelen | |
| 5,603,491 | A | | 2/1997 | Murrell | |
| 5,606,922 | A | | 3/1997 | Adams et al. | |
| 5,638,761 | A | | 6/1997 | Berkowitz et al. | |
| 5,816,374 | A | | 10/1998 | Hsien | |
| 5,836,595 | A | * | 11/1998 | Brice | 280/30 |
| 5,862,898 | A | | 1/1999 | Chang | |
| 5,934,641 | A | | 8/1999 | Vince | |
| 6,102,369 | A | | 8/2000 | Monger | |
| 6,182,935 | B1 | | 2/2001 | Talesky | |
| 6,360,797 | B1 | | 3/2002 | Brazell et al. | |
| 6,471,220 | B1 | | 10/2002 | Babb | |
| 6,578,856 | B2 | | 6/2003 | Kahle | |
| D486,504 | S | | 2/2004 | Huang | |
| 6,752,091 | B2 | | 6/2004 | Glover et al. | |
| 6,886,836 | B1 | | 5/2005 | Wise | |
| 6,892,860 | B2 | | 5/2005 | Gibson et al. | |
| 6,899,306 | B1 | | 5/2005 | Huang | |
| 6,942,229 | B2 | | 9/2005 | Brazell et al. | |
| D519,747 | S | | 5/2006 | Wu | |
| D523,041 | S | | 6/2006 | Wise | |
| 7,059,616 | B2 | | 6/2006 | Wu | |
| 7,077,421 | B2 | | 7/2006 | Wu | |
| 7,213,829 | B2 | * | 5/2007 | Wu | 280/645 |
| 7,222,865 | B2 | | 5/2007 | Chen et al. | |
| 7,255,355 | B2 | * | 8/2007 | Chisholm et al. | 280/30 |
| 7,278,646 | B2 | | 10/2007 | Chuang | |
| 7,308,858 | B2 | | 12/2007 | Lo et al. | |
| 7,334,592 | B2 | | 2/2008 | Tartaglia | |
| 7,464,956 | B2 | * | 12/2008 | Chen et al. | 280/639 |
| 7,681,893 | B2 | * | 3/2010 | Liu et al. | 280/35 |
| 7,849,966 | B2 | * | 12/2010 | Chiu | 182/153 |
| 8,096,519 | B2 | * | 1/2012 | Tam et al. | 248/434 |
| 2005/0011421 | A1 | | 1/2005 | Zhang | |
| 2005/0045781 | A1 | | 3/2005 | Brazell | |
| 2005/0120849 | A1 | | 6/2005 | Lee | |
| 2005/0120922 | A1 | | 6/2005 | Brooks | |
| 2005/0133682 | A1 | | 6/2005 | Huang | |
| 2005/0183559 | A1 | | 8/2005 | Rue | |
| 2005/0194215 | A1 | | 9/2005 | Radermacher | |
| 2005/0199768 | A1 | | 9/2005 | Tam et al. | |
| 2006/0011191 | A1 | | 1/2006 | Vavricek | |
| 2006/0021552 | A1 | | 2/2006 | Pleiman et al. | |
| 2006/0021553 | A1 | | 2/2006 | Pleiman et al. | |
| 2006/0071450 | A1 | | 4/2006 | Wu | |
| 2006/0075943 | A1 | * | 4/2006 | Chen et al. | 108/115 |
| 2006/0076756 | A1 | | 4/2006 | Wu | |
| 2007/0080488 | A1 | | 4/2007 | Chuang | |
| 2007/0102892 | A1 | | 5/2007 | Chiu | |
| 2008/0115701 | A1 | | 5/2008 | Sugiura | |

FOREIGN PATENT DOCUMENTS

| | | | |
|---|---|---|---|
| EP | 0 532 132 | A2 | 3/1993 |
| GB | 2 363 366 | A | 12/2001 |
| TW | M273664 | | 8/2005 |
| WO | WO 03064115 | A1 | 8/2003 |

* cited by examiner

FOLDABLE TOOL STAND

This application claims the benefit of U.S. Provisional Application No. 61/159,268, filed Mar. 11, 2009. This application also claims, under 35 U.S.C. §119, priority to Taiwanese Application No. 098107948, filed Mar. 11, 2009. Both U.S. Provisional Application No. 61/159,268 and Taiwanese Application No. 098107948 are hereby incorporated by reference herein in their entirety, inclusive of their specification, claims, and drawings.

FIELD OF THE INVENTION

The present invention generally relates to tool stands provided for supporting power tools thereon, and more particularly, to a foldable tool stand that can be easily and conveniently set between a collapsed, non-use or storage position, and an extended or supporting position.

BACKGROUND

Taiwan Patent Number M273664 discloses a collapsible tool stand, which comprises a platform, and a plurality of legs pivotally connected to the platform. When the collapsible tool stand is extended, multiple first locking devices are used to lock the legs in the extended position. When the collapsible tool stand is collapsed, multiple second locking devices are used to lock the legs in the collapsed position.

When the collapsible tool stand is in the collapsed position, the legs are received along the bottom side of the platform. Thus, the collapsible tool stand is maintained and supported in a flat manner on the floor. When it is desired to extend the collapsible tool stand from the collapsed position, the user must bend over or squat so that the user's hands can reach the legs of the collapsible tool stand and move the legs from the collapsed position to the extended position. However, a heavy tool (for example, a table saw) may be provided at the top side of the platform. Thus, when collapsing or extending the collapsible tool stand, an increased effort is required to manipulate the collapsible tool stand, and there is a substantial risk of injury to the user during the collapsing or extending of the collapsible tool stand.

SUMMARY

In view of the above discussion, an embodiment of a foldable tool stand that can be easily and conveniently set between a collapsed, non-use or storage position, and an extended or supporting position, while providing stable support in the extended supporting position, is described.

The foldable tool stand includes a base frame, a platform slidingly and pivotally connected at a first end thereof to the base frame, links pivotally connected at each end to an opposed second side of the platform and to the base frame respectively, and a leg support pivotally connected at top ends of first and second legs thereof to the base frame.

The first side of the platform is connected to the base frame in a pivotal manner via sliding sleeves that slide along the supports of the base frame, while allowing the platform to pivot with respect to the base frame. All of the pivot connections can be accomplished via the use of pivot holders. A first set of pivot holders provide the pivotal connection between the leg support and the base frame, while a second set of pivot holders provide the pivotal connection between the links and the base frame.

The foldable stand also includes a follower set and a driving device. The follower set includes a pivot shaft inserted through one of the respective second pivot holders, and a follower member pivotally connected to the respective pivot shaft. The follower member has a first locating portion defined thereon.

The driving device is pivotally coupled, in combination with the links, to the second pivot holders. The driving device also includes a second locating portion formed thereon.

The driving device is movable relative to the base frame between a first (extending) position and a second (collapsing) position. When the driving device is moved to the first position, the second locating portion of the driving device is engaged with the first locating portion of the follower member, thus locking the second side of the platform in the extended supporting position, spaced from the base frame.

When the driving device is moved to the second position, the second locating portion of the driving device is disengaged from the first locating portion of the follower member, and the links are moved towards a collapsed position, adjacent the base frame. The movement of the links to lie along the base frame causes the second end of the platform to be positioned adjacent to the base frame, as well as causes the first side of the platform to slide along the base frame, such that both the first and second sides of the platform lie along the base frame in a collapsed position.

By use of the interaction between the driving device and the follower set, the foldable tool stand provides a stable support effect, and can be conveniently collapsed into a storage position. The interaction between the driving device and the follower set also allows the foldable tool stand to be locked in either the extended supporting position, or the collapsed storage position.

In the extended supporting position of the foldable tool stand, the links provide structural support to maintain the platform in a generally level, supporting configuration, such that the platform is spaced from the base frame. When the foldable tool stand is collapsed, the links allow the platform to pivot with respect to the base frame, such that the platform lies against the base frame when the foldable tool stand is in the collapsed position.

The base frame can also include a transverse handle and wheels to allow the foldable tool stand (and tool supported thereon) to be easily transported when the foldable tool stand is in the collapsed position.

A retaining device can also be provided on the base frame to retain the leg support along the base frame when the foldable tool stand is in the collapsed position.

By way of the above-described configurations, the embodiment of a foldable tool stand disclosed herein provides an excellent supporting effect. Further, the use of the driving device operated by the user's foot to extend and collapse the stand prevents excessive bending of the user's body in order to manipulate the stand between the collapsed and extended positions.

BRIEF DESCRIPTION OF THE DRAWINGS

These and other features, aspects, and advantages of the present invention will become better understood with regard to the following description, appended claims, and accompanying drawings where:

Figure 1:
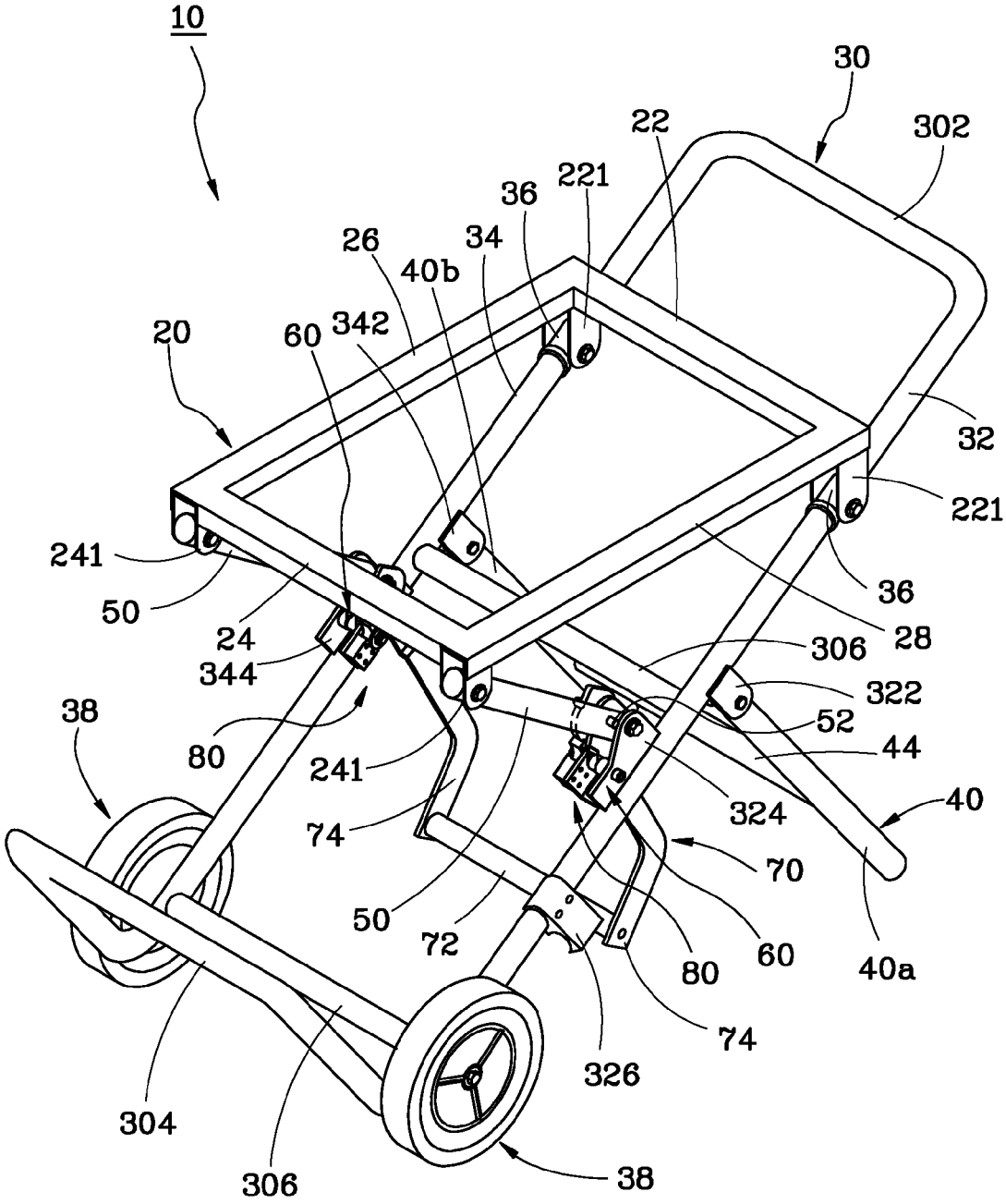
FIG. 1 is an oblique elevation view of a foldable tool stand in accordance with an embodiment of the present disclosure.

It should be noted that the drawing figures are not necessarily drawn to scale, but instead are drawn to provide a better understanding of the components thereof, and are not intended to be limiting in scope, but rather to provide exemplary illustrations. It should further be noted that the figures illustrate exemplary embodiments of a foldable tool stand and the components thereof, and in no way limit the structures or configurations of a foldable tool stand and components thereof according to the present disclosure.

DETAILED DESCRIPTION

A. Embodiment of a Foldable Tool Stand

An embodiment of a foldable tool stand 10 is shown in FIG. 1 generally having a platform 20 supported on a base frame 30 for relative movement with respect thereto.

The platform 20 is adapted to support a tool (not shown) on an upper support surface defined by the platform 20. The supported tool can be any suitable tool, for example, a table top tool, such as a table saw, miter saw, scroll saw, band saw, drill press, belt or rotary sander, or any other tool suitable for being supported on a folding tool stand as disclosed herein.

The platform 20 forms the tool supporting surface via a first side 22, a second side 24, a third side 26, and a fourth side 28. The platform 20 can be formed in any suitable shape, such as, for example, rectangular or square. The platform 20 includes pivot holders 221 at the first side 22 thereof, and pivot holders 241 at the second side 24 thereof, which is opposed to the first side 22. The platform 20 is supported on a base frame 30 for relative movement with respect thereto in a manner more fully described below.

As best seen in FIG. 1, the base frame 30 includes two generally parallel support rods 32, 34 that define two sides of the base frame 30. A generally transverse handle 302 is provided extending between the support rods 32, 34 at the top ends thereof to allow a user to maneuver the foldable tool stand 10 in the collapsed position, or in a partially extended position.

First and second transverse rods 306 are connected between the support rods 32, 34 near their bottom ends and middle portions thereof in order to reinforce the structural strength of the base frame 30. Two wheels 38 are respectively connected to the bottom ends of the support rods 32, 34 in a rotatable manner for supporting the folding tool stand 10 on a floor, so that in the collapsed position, the foldable tool stand 10 can be translated along the surface of a floor with ease.

Figure 8:
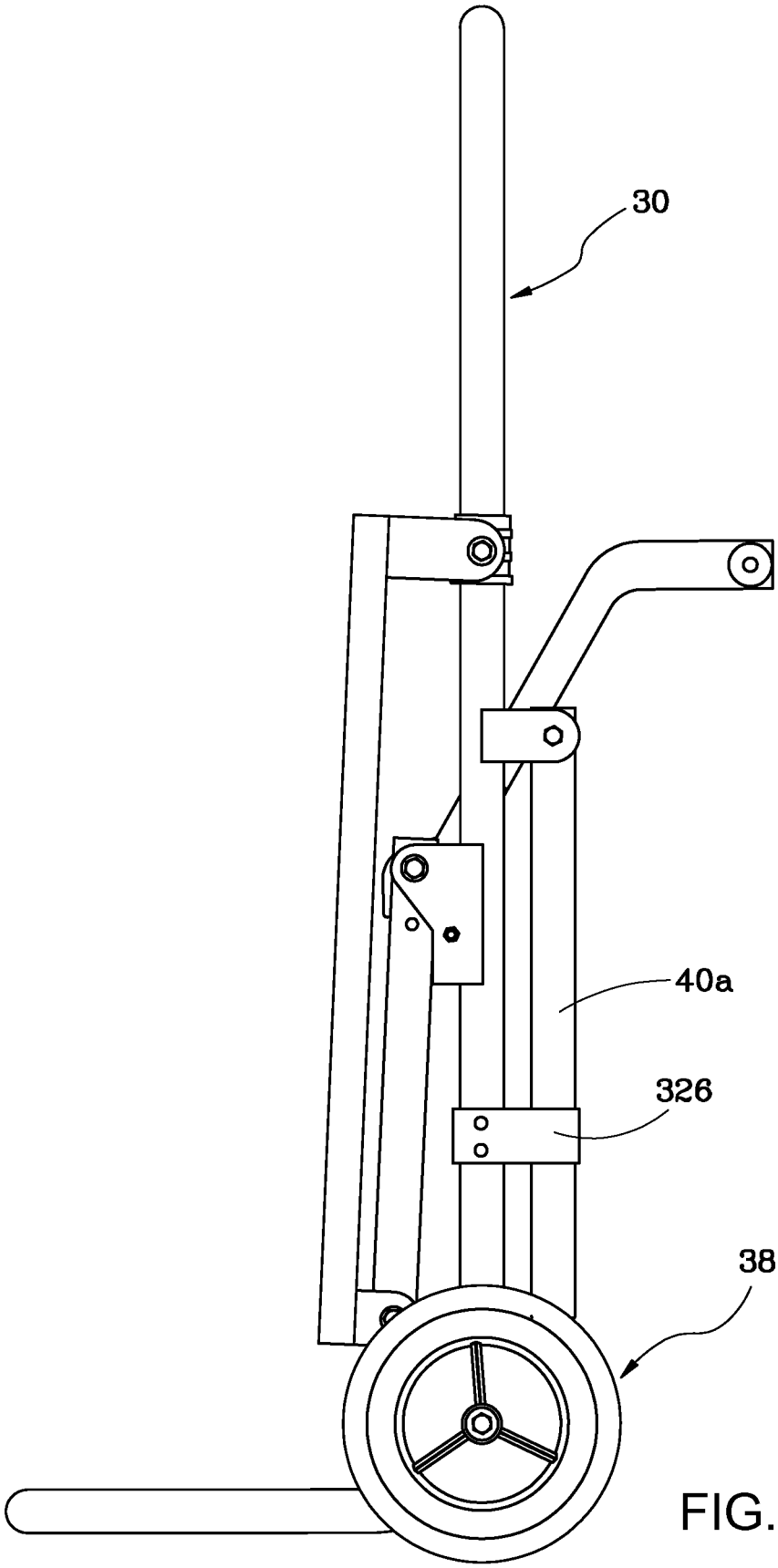
FIG. 8 is another side view of the foldable tool stand shown in FIG. 1 in a fully collapsed position.

A floor bar 304 is transversely connected between the bottom ends of the support rods 32, 34 at a predetermined angle for allowing the foldable tool stand 10 to stand upright when the foldable tool stand 10 is in the collapsed position, as can be seen in FIG. 8.

The support rods 32, 34 also include first pivot holders 322, 342 and second pivot holders 324, 344 thereon generally along a middle portion of the support rods 32, 34.

Figure 3:
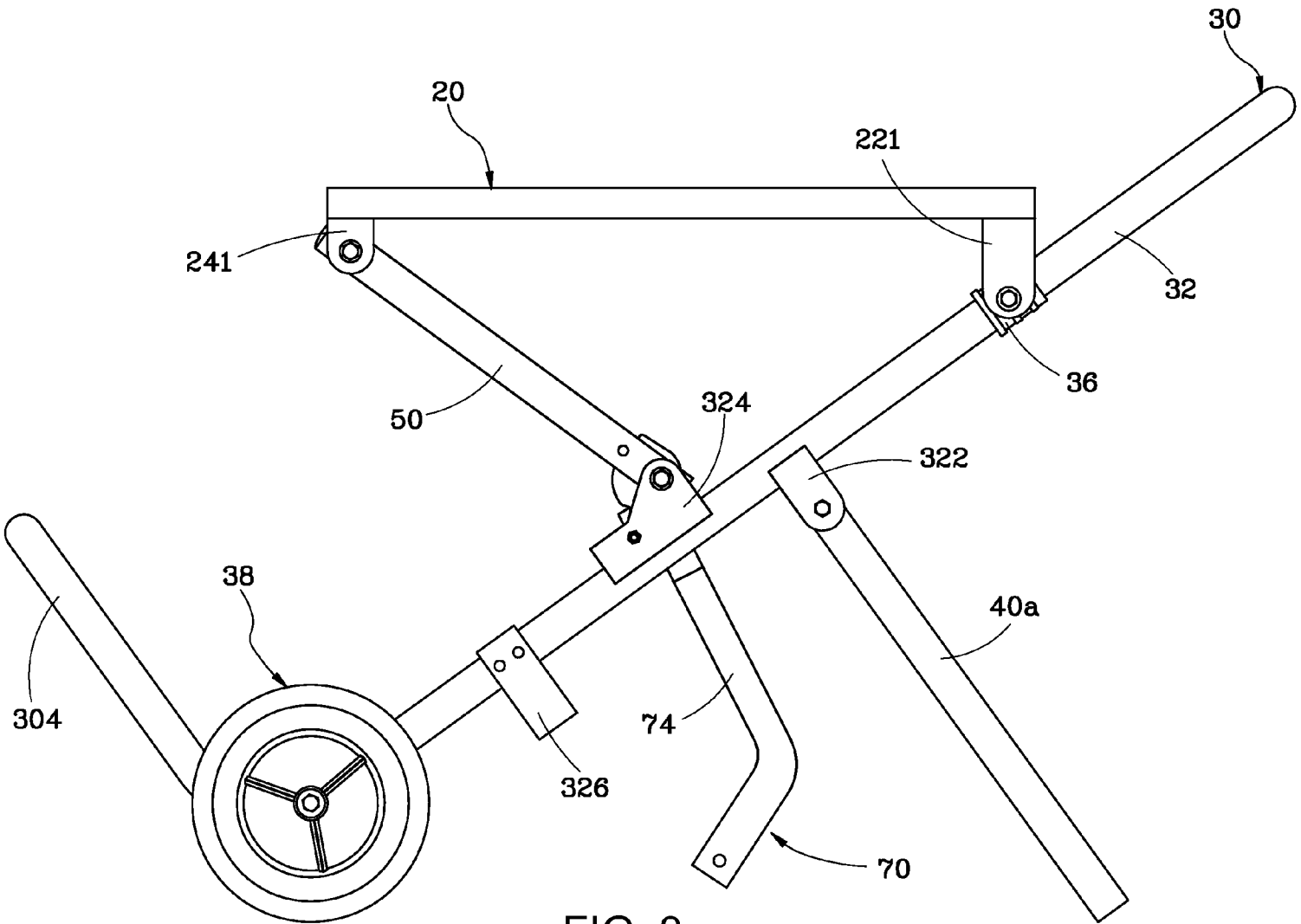
FIG. 3 is a side view of the foldable tool stand shown in FIG. 1.

As can be seen in FIGS. 1 and 3, the platform 20 is connected to the base frame 30 at the first side 22 by the pivot holders 221, which are pivotally coupled to sliding sleeves 36 arranged on the support rods 32, 34 between the first pivot holders 322, 342 and the transverse handle 302. Thus, the platform 20 is pivotally and slidably connected at the first side 22 thereof to the base frame 30. The platform 20 is connected to the base frame 30 at the second side 24 by the pivot holders 241, which are pivotally coupled to upper ends of links 50. Lower ends of the links 50 are pivotally coupled to the second pivot members 324, 344 on the base frame 30, and also include protruding rods 52. Thus, the links 50 are pivotally coupled between the second side 24 of the platform 20 and the base frame 30 such that the links 50 guide and support the second side 24 of the platform spaced away from the base frame 30 when the foldable tool stand 10 is in the extended supporting position, and the links 50 further guide and support the second side 24 of the platform 20 adjacent to the base frame 30 when the foldable tool stand 10 is in the collapsed position.

As best seen in FIGS. 1, 3, 6, and 8, this configuration allows the platform 20 to be manipulated back and forth from a collapsed, storage position to an extended supporting position.

As shown in FIGS. 1, 3 and 8, a leg support 40 connected to the base frame 30 is formed of two generally parallel legs 40*a*, 40*b* having a second transverse rod 44 positioned therebetween for increased structural support. The leg support 40 is configured to be swung from a collapsed, storage position along the base frame 30 (FIG. 8) to an extended support position (FIGS. 1, 3, 6) for engagement with a supporting surface, such as the floor. The movement of the leg support 40 is accomplished by having the top ends of the legs 40*a*, 40*b* pivotally connected to the base frame at the respective first pivot holders 324, 344, which are positioned generally along the middle portion of the respective support rods 32, 34.

As shown in FIGS. 1, and 3, a retaining device 326 is provided near a bottom end of at least one support rod (as shown, support rod 32) to selectively engage at least one leg (as shown, leg 40*a*) of the leg support 40 to retain the leg support 40 in the collapsed, storage position.

When the leg support 40 is extended to the support position, the foldable tool stand 10 is supported on the supporting surface, such as the floor, by the wheels 38, and the bottom ends of the legs 40*a*, 40*b*. Since the bottom ends of the legs 40*a*, 40*b* do not have wheels thereon, the foldable tool stand 10 is stably supported on the supporting surface.

From the above discussion, it can be seen that the leg support 40 is pivotable between a first position adjacent the base frame 30 when the foldable tool stand 10 is in the collapsed position, and a second position spaced from the base frame 30 when the foldable tool stand 10 is in the supporting position.

If it is desired to relocate the tool supported on the foldable tool stand 10, the entire stand can be manipulated to the collapsed, storage position shown in FIG. 8. Alternatively, the leg support 40 can be collapsed to the storage position so that the foldable tool stand 10 can be maneuvered using the wheels 38, which form the only points of contact between the foldable tool stand 10 and the supporting surface when the leg support 40 is retained against the base frame 30 by the retaining device 326.

Another feature of the embodiment of the foldable tool stand 10 shown in FIG. 1 is the use of a driving device 70, which cooperates with a pair of follower sets 60 and positioning devices 80, in order to shift and lock the platform 20 between the collapsed storage position and the extended supporting position, in a manner to be more fully discussed below.

As shown in FIGS. 1-5 and 7, the driving device 70 includes an actuating pedal bar 72 extending transversely between two side bars 74, which are respectively pivotally connected to the second pivot holders 324, 344 of the support rods 32, 34 of the base frame 30. The side bars 74 are connected to the second pivot holders 324, 344 by using the same pivot connection (shaft) as the respective links 50, such that the side bars 74 are also pivotally connected to the links 50.

The side bars 74 are fixedly connected to the actuating pedal bar 72 at the distal ends thereof, and as just discussed, have the top ends thereof pivotally connected with the links 50.

A distance as measured between the top ends of the side bars 74 and the second pivot holders 324, 344 of the base frame 30 is shorter than a distance as measured between the distal ends of the side bars 74 and the second pivot holders 324, 344 of the base frame, thus providing a lever configuration having a mechanical advantage.

Figure 4:
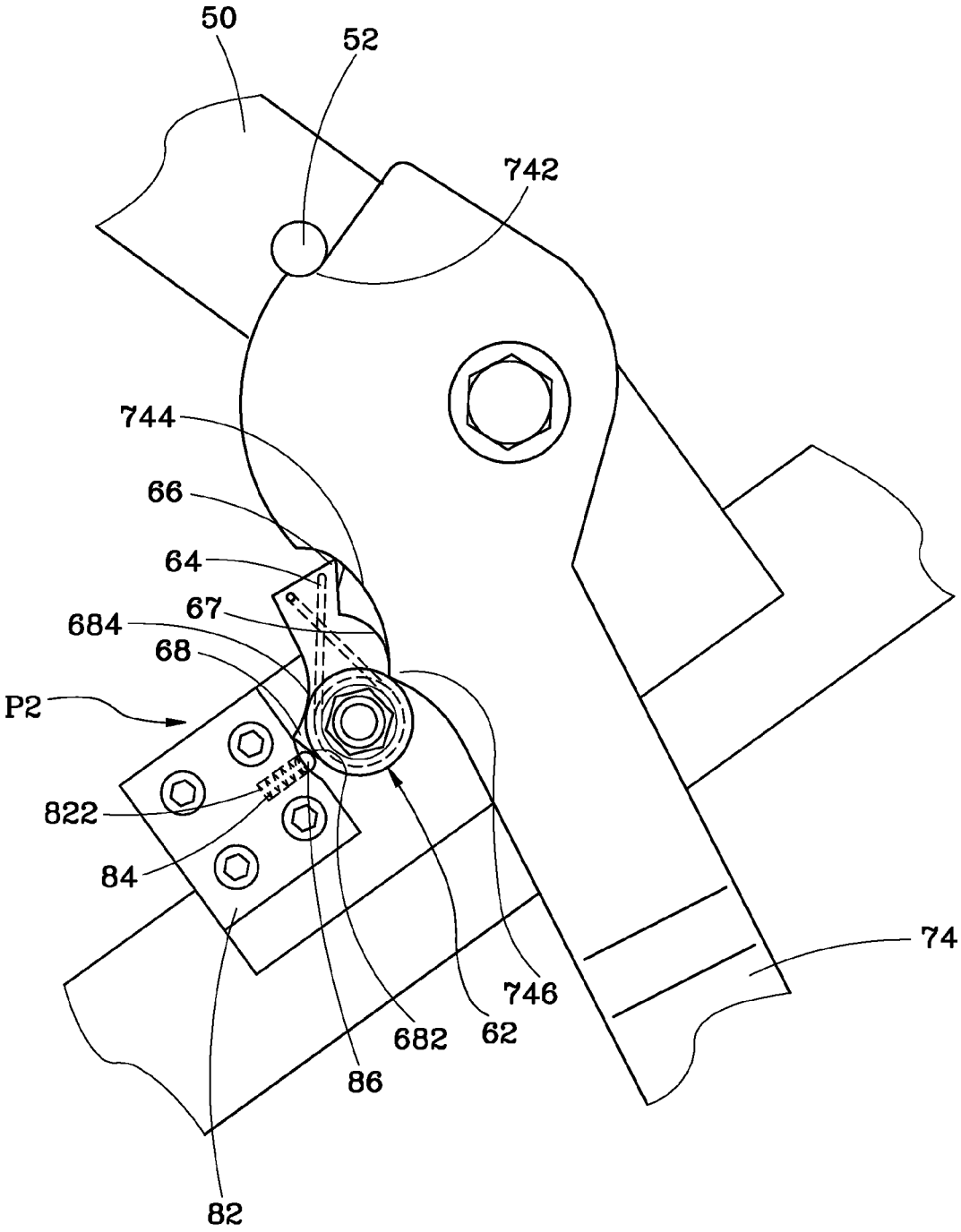
FIG. 4 is an enlarged side view of a part of the foldable tool stand shown in FIG. 1, showing the first locating portion of the follower member engaged with the second locating portion of the driving device.

As shown in FIG. 4, each side bar 74 has a recessed portion 742 formed at the top ends thereof for receiving the protruding rod 52 of the link 50 associated with the respective side bar 74. The protruding rods 52 of the links 50 cooperate with the top ends of the side bars 74, and the recessed portions 742, such that movement of the driving device 70 can assist with extending the platform 20 to the supporting position, or collapsing the platform 20 to the storage position.

In order to selectively lock the foldable stand 10, in particular the platform 20, in the extended supporting position or the collapsed storage position, a pair of follower sets 60 and positioning devices 80 are provided, which cooperate with the driving device 70 in the manner discussed below.

As shown in FIGS. 2, 4, 5, and 7, each follower set 60 includes a pivot shaft 61 that passes through the respective second pivot holder 324, 344 of the support rods 32, 34 of the base frame 30. A follower member 62, a sleeve 63, a torsional spring 64, and a bushing 65 are all rotatably or pivotally provided on the pivot shaft 61.

Figure 2:
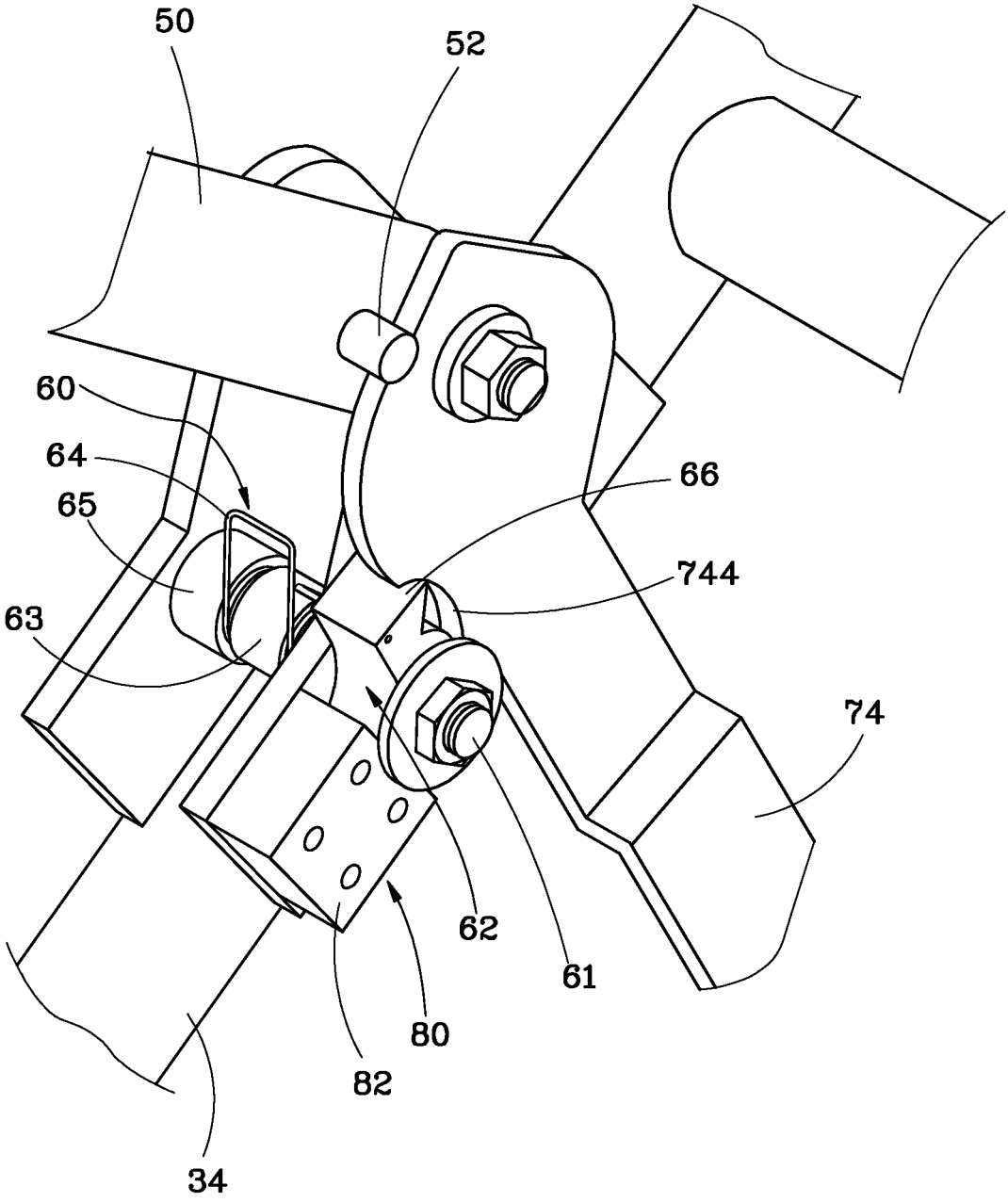
FIG. 2 is an enlarged view of a part of the foldable tool stand shown in FIG. 1.
Figure 5:
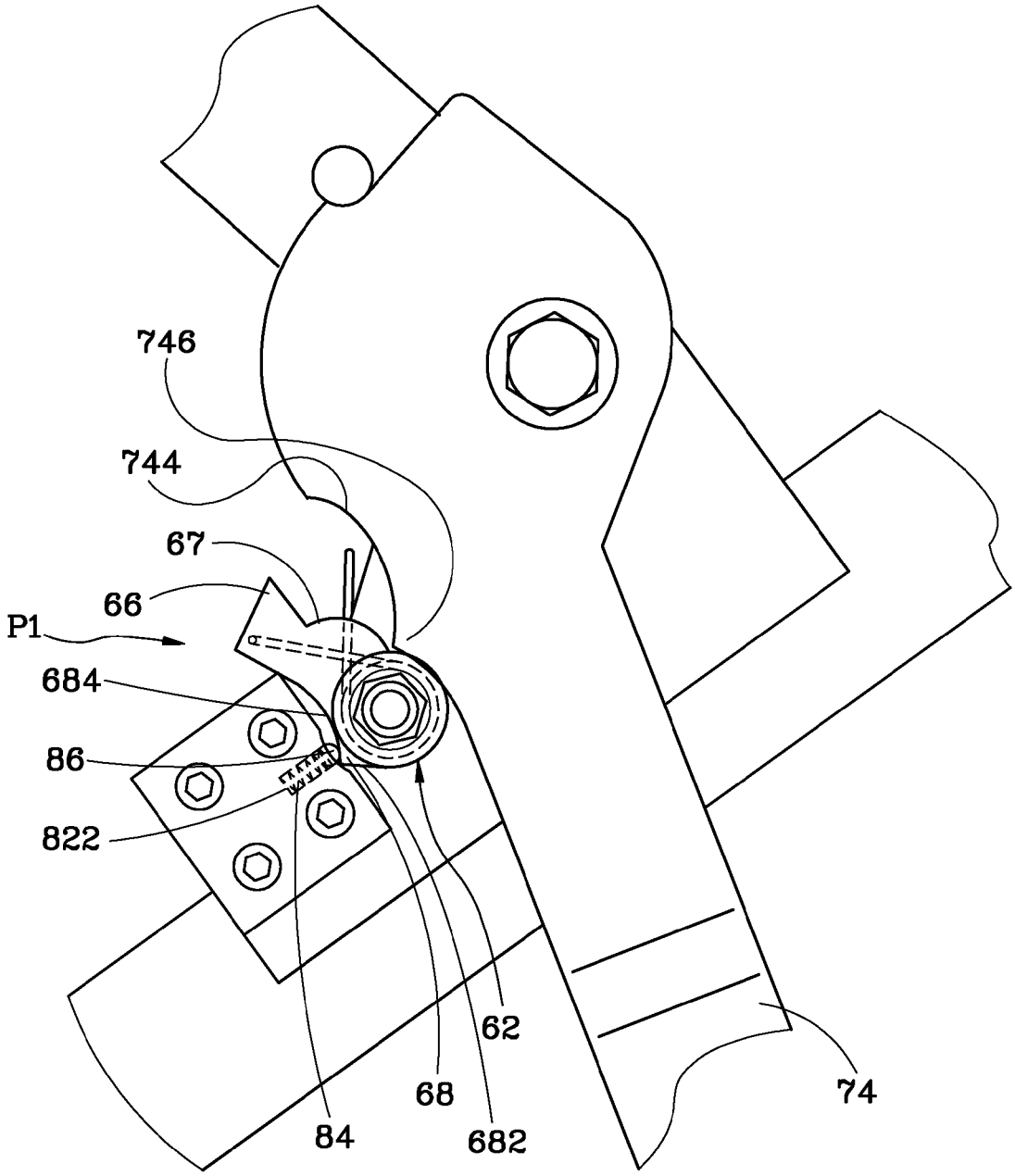
FIG. 5 is a view similar to FIG. 4 showing the first locating portion of the follower member disengaged from the second locating portion of the driving device.

As seen in FIGS. 2, 4, and 5, the follower member 62 is pivotally connected to a first end of the pivot shaft 61, and includes a first locating portion 66, a follower protruding portion 67 adjacent to and abutting the a first locating portion 66, and a stop portion 68 positioned on a side of the follower member 62 generally opposed to the first locating portion 66 and follower protruding portion 67. The first locating portion 66 can include a slanted surface that is canted towards the follower protruding portion 67, which can be in the form of a generally circular surface.

As seen in FIG. 2, the sleeve 63 is rotatably arranged on the pivot shaft 61. The torsional spring 64 is wound around the sleeve 63 and has one end thereof connected to the follower member 62. Alternatively, the torsional spring 64 can be wound directly around the pivot shaft 61 without the use of the sleeve 63. The bushing 65 is arranged at a second end of the pivot shaft 61 between the sleeve 63 and a flange of the respective second pivot holder 324, 344.

As best seen in FIGS. 2, 4, and 5, each side bar 74 of the driving device 70 has a second locating portion 744 formed near the top end thereof, and configured for selective engagement with the first locating portion 66 of the associated follower member 62.

Further, as best seen in FIGS. 4 and 5, each side bar 74 of the driving device 70 also has a driving protrusion 746 formed near the top end thereof, and configured for selective engagement with the follower protruding portion 67 of the associated follower member 62. The cooperative relationship between the a second locating portions 744 and the first locating portions 66, and the driving protrusions 746 and the follower protruding portions 67 is discussed in more detail below.

In order to aid with selectively locking the platform 20 in the extended supporting position or the collapsed storage position, a positioning device 80 is provided with each follower set 60.

As shown in FIGS. 2, 4, 5, and 7, each positioning device 80 includes a locating block 82 attached to a flange of the respective second pivot holder 324, 344 at the same side thereof as the follower member 62 of the follower set 60.

As can be seen in FIGS. 4 and 5, each locating block 82 includes a receptacle 822 for receiving a spring member 84 therein. A positioning rod 86 is supported on the spring member 84, and is biased out of the receptacle 822 and into engagement with the respective follower member 62 of the follower set 60. As will be discussed in more detail below, the positioning rod 86 cooperates with the stop portion 68 of the follower member 62 to aid with selectively locking the platform 20 in the extended supporting position or the collapsed storage position.

Turning to the operation of the foldable tool stand 10, the following steps can be used to collapse the foldable tool stand 10 from the extended supporting position to the collapsed storage position. When the foldable tool stand 10 is in the extended supporting position shown in FIGS. 1 and 3, a user can place their foot on the actuating pedal 72 of the driving device 70, and apply a downward force thereto in order to move the driving device into the initiating position P1 (FIG. 5) to collapse the foldable tool stand 10.

As shown between FIGS. 4 and 5, with the motion of the driving device 70 that is supplied by the application of downward force on the actuating pedal 72, the driving protrusions 746 of the driving device 70 cooperate to push the follower protruding portions 67 of the follower members 62 of the follower sets 60 in order to move the follower members 62 from the position shown in FIG. 4 to the position shown in FIG. 5. In the position shown in FIG. 5, the first locating portions 66 of the follower members 62 are disengaged from the second locating portions 744 of the driving device 70.

As shown in FIG. 4, a first stop face 682 of the stop portions 68 of the follower members 62 cooperates with the respective positioning rod 86, which is biased into contact with the first stop face 682 in order to aid with locking the platform 20 in the extended position. The frictional engagement between the first stop face 682 of the stop portions 68 and the respective positioning rod 86 provides an inertial force that must be overcome, by applying a downward force to the actuating pedal 72 of the driving device 70, before the follower member 62 can move to allow the platform 20 to be moved between extended and collapsed positions.

As the follower members 62 are moved from the position shown in FIG. 4 to the position shown in FIG. 5, the stop portions 68 engage the respective positioning rod 86, and push the positioning rod 86 against the biasing force of the spring member 84 into the receptacle 822 until the stop member passes over the positioning rod 86. At this time, a second stop face 684 of the stop portions 68 of the follower members 62 cooperates with the respective positioning rod 86. As shown in the Figures, the first and second stop faces 682, 684 are formed on opposed sides of a protrusion that defines the stop portion 68.

Further, during the movement of the follower members 62 from the position shown in FIG. 4 to the position shown in FIG. 5, the follower members 62 rotate against the end of the torsional springs 64 connected thereto, thus causing the torsional springs 64 to store torsional energy/spring force.

Once the follower members 62 are moved to the position shown in FIG. 5, the engagement of the second stop face 684 of the stop portions 68 of the follower members 62 with the respective positioning rod 86 prevents the movement of the follower members 62 (by way of the stored spring force in the torsional springs 64) towards the driving device 70.

Figure 6:
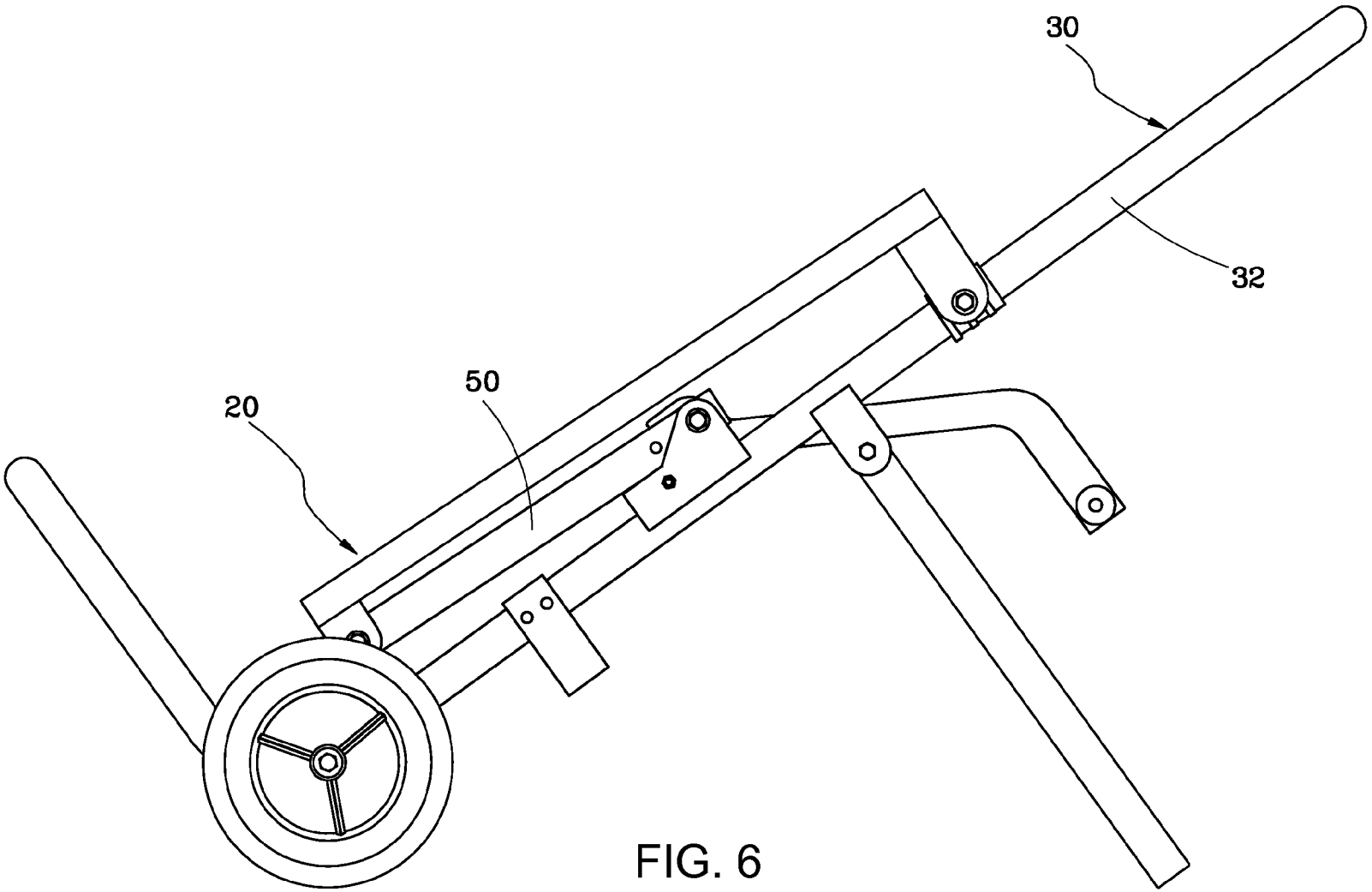
FIG. 6 is a side view of the foldable tool stand shown in FIG. 1 in a partially collapsed position with the second side of the platform in close proximity adjacent to the base frame.

Further, when the follower members 62 are moved to the position shown in FIG. 5, the second side 24 of the platform 20 can be lowered along the support rods 32, 34 of the base frame 30 to the collapsed position adjacent the base frame 30, as shown in FIGS. 6 and 8, by way of the cooperation of the links 50 with the side bars 74 of the driving device 70. This can be accomplished by the user maintaining a downward force on the actuating pedal 72 of the driving device 70 that offsets the weight of the platform 20 and the tool supported thereon.

The user can incrementally reduce the amount of the downward force applied to the actuating pedal 72 by gently lifting their foot, such that the downward shift in the center of gravity of the platform 20 and the tool supported thereon causes the actuating pedal 72 of the driving device 70 to move to the position shown in FIG. 6. In this manner, the links 50 guide the platform 20 to move towards the base frame 30, thus lowering the center of gravity of the whole foldable tool stand 10 in order to set the platform 20 in the collapsed position. This thus facilitates a smooth and safe collapse of the platform 20 to the collapsed position shown in FIG. 6.

Figure 7:
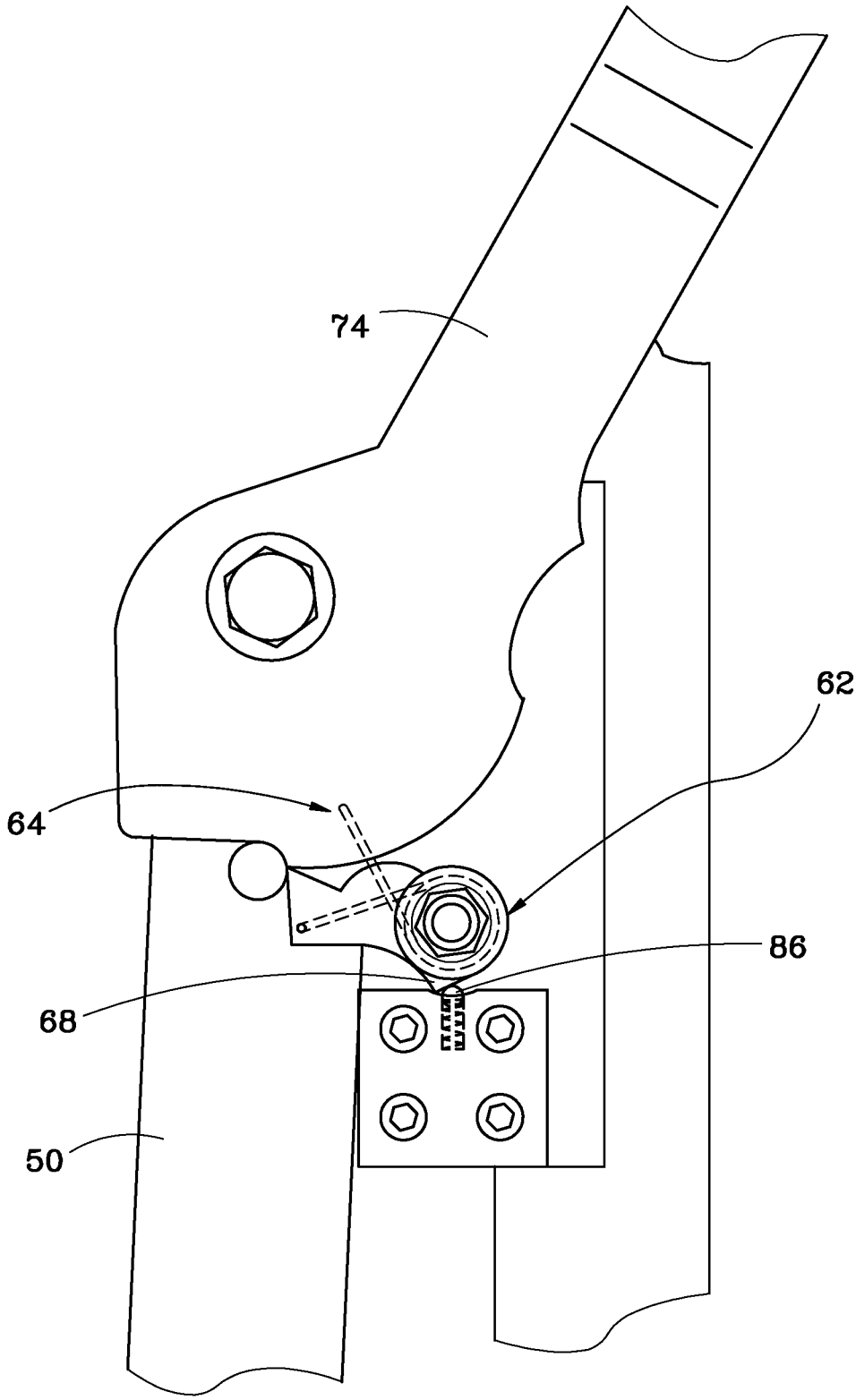
FIG. 7 is a view similar to FIG. 5 showing one of the links pressed against a torsional spring of the follower member, such that the follower member is biased towards the second locating portion of the driving device.

During the collapse of the platform 20 to the collapsed position shown in FIG. 6, as the second side 24 of the platform 20 approaches the base frame 30, the bottom ends of the links 50 contact the torsional springs 64 of the follower sets 60 (as shown in FIG. 7), which further causes the torsional springs 64 to bias the follower members 62 towards the driving device 70. Thus, the stop portions 68 of the follower members 62 are disengaged from the respective positioning rods 86 of the positioning devices 80, such that the follower members 62 can be moved towards the driving device 70 until the follower members 62 come into contact with the side bars 74 of the driving device (as shown in FIG. 7).

Once the platform 20 has been collapsed against the base frame 30, as shown in FIG. 6, the user can tilt the foldable tool stand 10 slightly, about the wheels 38, by lifting upwards on the transverse handle 302 in order to take the weight of the foldable tool stand 10 off of the leg support 40. Thereafter, the user can move the two legs 40*a*, 40*b* of the leg support 40 towards the base frame 30 by rotating the legs 40*a*, 40*b* about the first pivot holders 322, 342 until at least one of the legs (as illustrated, 40*a*) comes into engagement with the retaining device 326 (as shown in FIG. 8).

At this time, the foldable tool stand 10 is completely collapsed to the storage position, and the user can relocate the stand to a storage area, or to a new operating position, by pushing or pulling the transverse handle 302 of the foldable tool stand 10 such that wheels 38 of the foldable tool stand 10 rotate on the supporting surface.

In order to extend the foldable tool stand 10 to the supporting position from the collapsed, storage position, the user can grasp the transverse rod 44 and pull the leg support 40 away from the base frame 30. When this is done, the leg (as illustrated, 40*a*) of the leg support 40 that is retained by the retaining device 326 will disengage from the retaining device 326.

Once the foldable tool stand 10 is supported on the floor by the wheels 38 and the legs of the leg support 40, as shown in FIG. 6, the user can place their foot on the actuating pedal 72 of the driving device 70 and apply a downward force thereto in order to raise the platform 20 into the extended position, as shown in FIGS. 1 and 3.

This is accomplished by the transference of the downward force on the actuating pedal 72 to the side bars 74 of the driving device 70, such that the links 50, which are connected with the side bars 74, are rotated about the first pivot holders 322, 342 such that the second side 24 of the platform 20 is moved away from the base frame 30, and the first side 22 of the platform 20 is raised by sliding movement of the sleeves 36 on the support rods 32, 34.

In particular, when the driving device is moved from the collapsed position shown in FIGS. 6-8 to the extended position P2, shown in FIG. 4, the links 50 are released from engagement with the torsional springs 64 of the follower sets 60, and the follower members 62 are then biased by the torsional springs 64 such that the first locating portions 66 of the follower members 62 are moved into engagement with the second locating portions 744 of the side bars 74 of the locating device 70 in order to retain the driving device 70 in the extended position P2 as shown in FIG. 4. The interaction between the stop portions 68 of the follower members 62 with the respective positioning rod 86 of the positioning devices 80 is as previously described.

At this time, as previously discussed for the extended supporting position, the second side 24 of the platform 20 is maintained spaced from the base frame 30, and is supported on the links 50 at a predetermined elevation, as shown in FIG. 3. Further, as shown in FIG. 2, the protruding rods 52 of the links 50 are respectively received in the recessed portions 742 at the upper ends of the side bars 74 of the driving device, which also helps to prevent accidental unwanted movement of the platform from the extended position to the collapsed position.

Thus, in accordance with the present disclosure, the foldable tool stand provides a stable support, and is easy to manipulate between the collapsed and extended positions, simply by applying a downward force to the actuating pedal of the driving device. Therefore, the foldable tool stand is very easy to use.

B. Conclusion

It will be recognized that the foldable tool stand and components thereof can be made from any suitable materials.

Of course, it is to be understood that not necessarily all objects or advantages may be achieved in accordance with any particular embodiment of the invention. Thus, for example, those skilled in the art will recognize that the invention may be embodied or carried out in a manner that achieves or optimizes one advantage or group of advantages as taught herein without necessarily achieving other objects or advantages as may be taught or suggested herein.

The skilled artisan will recognize the interchangeability of various disclosed features and variations. In addition to variations described herein, other known equivalents for each feature can be mixed and matched by one of ordinary skill in this art to construct a foldable tool stand in accordance with principles of the present invention.

Although this invention has been disclosed in the context of exemplary embodiments and examples, it therefore will be understood by those skilled in the art that the present invention extends beyond the specifically disclosed embodiments to other alternative embodiments and/or uses of the invention and obvious modifications and equivalents thereof. Thus, it is intended that the scope of the present invention herein disclosed should not be limited by the particular disclosed embodiments described above.

What is claimed is:

1. A foldable tool stand, comprising:

a base frame having a pair of first and second pivot holders positioned thereon;

a platform having first and second opposed sides, the first side of the platform slidingly and pivotally connected to the base frame;

a pair of links respectively pivotally coupled between the second side of the platform and the second pivot holders of the base frame;

a leg support having a top side thereof pivotally connected to the first pivot holders of the base frame;

a driving device pivotally coupled with the links to the second pivot holders of the base frame;

at least one follower set having a pivot shaft inserted through a second pivot holder of the base frame, and a follower member pivotally connected to the pivot shaft;

the follower member having a first locating portion, and the driving device having a second locating portion; and wherein the driving device is movable relative to the base frame between a) an extended position, where the second locating portion of the driving device is engaged with the first locating portion of the follower member so that the second side of the platform is maintained in an extended position spaced from the base frame, and b) a collapsed position, where the second locating portion of the driving device is disengaged from the first locating portion of the follower member so that the links are pivotable so that the first side of the platform slides along the base frame and the second side of the platform is moved to a collapsed position adjacent to the base frame.

2. The foldable tool stand according to claim 1, wherein the driving device comprises:

two side bars, each having a top end cooperating with a respective link; and one side bar having the second locating portion of the driving device formed thereon.

3. The foldable tool stand according to claim 2, wherein each side bar of the driving device has a recessed portion located on the top end thereof; and each link has a protruding rod for positioning in the respective recessed portion of the respective side bar.

4. The foldable tool stand according to claim 2, wherein the driving device further comprises:

an actuating pedal connected between each of the side bars at respective distal ends thereof.

5. The foldable tool stand according to claim 4, wherein a distance measured between the top ends of the side bars of the driving device and the second pivot holders is shorter than a distance measured between the distal ends of the side bars of the driving device and the second pivot holders.

6. The foldable tool stand according to claim 2, wherein each side bar of the driving device has a driving protrusion disposed adjacent to the second locating portion; and the follower member of the follower set includes a follower protruding portion; wherein, when the driving device is moved from the extended position to the collapsed position, the driving protrusion forces the follower protruding portion to move the follower member away from the driving device.

7. The foldable stand according to claim 6, wherein the first locating portion includes a slanted surface that is canted towards the follower protruding portion, which has a generally circular surface.

8. The foldable tool stand according to claim 1, wherein the follower set comprises:

a torsional spring mounted on the pivot shaft and connected to the follower member; and wherein when the second side of the platform is collapsed adjacent to the base frame, a respective one of the links engages the torsional spring to bias the follower member toward the driving device.

9. The foldable tool stand according to claim 1, further comprising:

a positioning device having a locating block, a spring member and a positioning rod;

the locating block having a receptacle and being connected to the second pivot holder of the base frame having the follower set connected thereto, the spring member being mounted in the receptacle, and the positioning rod supported on the spring member and biased by the spring member out of the receptacle against the follower member; and the follower member having a stop portion cooperating with the positioning rod to selectively prohibit movement of the follower member toward the driving device.

10. The foldable stand according to claim 9, wherein the stop portion of the follower member includes first and second stop faces on opposed sides of a protrusion forming the stop portion.

11. The foldable stand according to claim 1, wherein when the foldable stand is moved to the collapsed position, the pair of links guides the second side of the platform toward the base frame to lower the center of gravity of the whole foldable stand, and to set the platform in the collapsed position.

12. A foldable tool stand, comprising:

a base frame having a pair of first and second pivot holders positioned thereon;

a platform having first and second opposed sides, the first side of the platform slidingly and pivotally connected to the base frame;

a pair of links respectively pivotally coupled between the second side of the platform and the second pivot holders of the base frame;

a leg support having two legs respectively having top sides pivotally connected to the respective first pivot holders of the base frame a driving device having two side bars respectively pivotally coupled at top ends thereof with the respective links to the second pivot holders of the base frame;

a pair of follower sets each having a pivot shaft inserted through the respective second pivot holders of the base frame, and a follower member pivotally connected to the pivot shaft;

the follower members each having a first locating portion, and the driving device having two second locating portions; and wherein the driving device is movable relative to the base frame between a) an extended position, where the second locating portions of the driving device are engaged with the first locating portions of the follower members so that the second side of the platform is maintained in an extended position spaced from the base frame, and b) a collapsed position, where the second locating portions of the driving device are disengaged from the first locating portions of the follower members so that the links are pivotable so that the first side of the platform slides along the base frame and the second side of the platform is moved to a collapsed position adjacent to the base frame.

13. The foldable tool stand according to claim 12, wherein the driving device further comprises;

an actuating pedal connected between each of the side bars at respective distal ends thereof; and wherein a distance measured between the top ends of the side bars of the driving device and the second pivot holders is shorter than a distance measured between the distal ends of the side bars of the driving device and the second pivot holders.

14. The foldable tool stand according to claim 13, wherein each side bar of the driving device has a recessed portion located on the top end thereof; and each link has a protruding rod for positioning in the respective recessed portion of the respective side bar.

15. The foldable tool stand according to claim 14, wherein each side bar of the driving device has a driving protrusion disposed adjacent to the second locating portion; and the follower member of the follower set includes a follower protruding portion; wherein, when the driving device is moved from the extended position to the collapsed position, the driving protrusion forces the follower protruding portion to move the follower member away from the driving device.

16. The foldable stand according to claim 15, wherein the first locating portion includes a slanted surface that is canted towards the follower protruding portion, which has a generally circular surface.

17. The foldable tool according to claim 14, wherein the follower sets comprise:

a torsional spring mounted on the pivot shaft and connected to the follower member; and wherein when the second side of the platform is collapsed adjacent to the base frame, a respective one of the links engages the torsional spring to bias the follower member toward the driving device.

18. The foldable tool stand according to claim 17, further comprising a pair of positioning devices corresponding to the pair of follower sets, each positioning device comprising:

a locating block, a spring member and a positioning rod;

the locating block having a receptacle and being connected to the second pivot holder of the base frame, the spring member being mounted in the receptacle, and the positioning rod supported on the spring member and biased by the spring member out of the receptacle against the follower member; and the follower member having a stop portion cooperating with the positioning rod to selectively prohibit movement of the follower member toward the driving device.

19. The foldable stand according to claim 18, wherein the stop portion of the follower member includes first and second stop faces on opposed sides of a protrusion forming the stop portion.

20. The foldable stand according to claim 12, wherein when the foldable stand is moved to the collapsed position, the pair of links guides the second side of the platform toward the base frame to lower the center of gravity of the whole foldable stand, and to set the platform in the collapsed position.

* * * * *